US009928798B2

(12) United States Patent
Um et al.

(10) Patent No.: US 9,928,798 B2
(45) Date of Patent: Mar. 27, 2018

(54) METHOD AND DEVICE FOR CONTROLLING VOLTAGE OF ELECTRODE

(71) Applicant: BOE TECHNOLOGY GROUP CO., LTD., Beijing (CN)

(72) Inventors: Yoon Sung Um, Beijing (CN); Hyun Sic Choi, Beijing (CN); Zhiqiang Xu, Beijing (CN); Hui Li, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 14/381,719

(22) PCT Filed: Dec. 19, 2013

(86) PCT No.: PCT/CN2013/089909
§ 371 (c)(1),
(2) Date: Aug. 28, 2014

(87) PCT Pub. No.: WO2014/187124
PCT Pub. Date: Nov. 27, 2014

(65) Prior Publication Data

US 2015/0325161 A1 Nov. 12, 2015

(30) Foreign Application Priority Data

May 23, 2013 (CN) ..... 2013 1 0195583

(51) Int. Cl.
*G09G 3/20* (2006.01)
*G09G 3/36* (2006.01)

(52) U.S. Cl.
CPC ..... *G09G 3/3688* (2013.01); *G09G 3/20* (2013.01); *G09G 3/3655* (2013.01);
(Continued)

(58) Field of Classification Search
CPC ..... G09G 3/3655; G09G 3/3688; G09G 2320/0219; G09G 2320/0242;
(Continued)

(56) References Cited

U.S. PATENT DOCUMENTS 5,771,030 A 6/1998 Suzuki et al.
7,817,122 B2 10/2010 Jang et al.
(Continued)

FOREIGN PATENT DOCUMENTS

CN 1637477 A 7/2005
CN 101382711 A 3/2009
(Continued)

OTHER PUBLICATIONS

English Translation of the International Search Report of PCT/CN2013/089909 published in English dated Nov. 27, 2014.
(Continued)

*Primary Examiner* — Bryan Earles
(74) *Attorney, Agent, or Firm* — Collard & Roe, P.C.

(57) ABSTRACT

A voltage control method and device for electrodes, wherein the method includes inputting a varying voltage signal to common electrodes on an array substrate. The solution of the present application may avoid the problem of greenish picture of products due to influence of data line voltage on common electrodes.

8 Claims, 3 Drawing Sheets

(52) U.S. Cl.
CPC . *G09G 2230/00* (2013.01); *G09G 2320/0219* (2013.01); *G09G 2320/0242* (2013.01); *G09G 2330/028* (2013.01); *G09G 2360/16* (2013.01)

(58) Field of Classification Search
CPC ..... G09G 2360/16; G09G 2230/00; G09G 2330/028; G09G 3/3696; G09G 2310/0289; G09G 2330/08
See application file for complete search history.

(56) References Cited

U.S. PATENT DOCUMENTS 8,269,707 B2 * 9/2012 Woo ..... G09G 3/3614 345/84
8,284,184 B2 10/2012 Dou
2008/0309590 A1 * 12/2008 Hong ..... G09G 3/3614 345/52
2009/0066627 A1 * 3/2009 Yin ..... G09G 3/3233 345/94
2009/0267884 A1 * 10/2009 Takahashi ..... G09G 3/3648 345/96
2010/0073341 A1 * 3/2010 Toyooka ..... G09G 3/3614 345/208
2010/0207966 A1 * 8/2010 Hosaka ..... G09G 3/002 345/690
2010/0309189 A1 * 12/2010 Mizusako ..... G09G 3/3614 345/212
2011/0234930 A1 * 9/2011 Nishida ..... G09G 3/3655 349/33
2014/0085345 A1 3/2014 Ma et al.
2014/0092077 A1 * 4/2014 Kim ..... G09G 3/3611 345/212
2014/0132842 A1 * 5/2014 Tsuchiya ..... G09G 3/2011 348/728

FOREIGN PATENT DOCUMENTS

CN 101398550 A 4/2009
CN 102902122 A 1/2013
CN 102903344 A 1/2013
CN 103268748 A 8/2013

OTHER PUBLICATIONS

International Search Report, International Preliminary Report on Patentability and Written Opinion of the International Searching Authority of PCT/CN2013/089909 in Chinese, dated Apr. 30, 2014.
Chinese Office Action of Chinese Application No. 201310195583.3, dated Feb. 28, 2015 with English translation.
English translation of the International Preliminary Report on Patentability and Written Opinion of the International Searching Authority of PCT/CN2013/089909, dated Nov. 24, 2015.

* cited by examiner

METHOD AND DEVICE FOR CONTROLLING VOLTAGE OF ELECTRODE

CROSS REFERENCE TO RELATED APPLICATIONS

This application is the National Stage of PCT/CN2013/089909 filed on Dec. 19, 2013, which claims priority under 35 U.S.C. § 119 of Chinese Application No. 201310195583.3 filed on May 23, 2013, the disclosure of which is incorporated by reference.

FIELD OF THE INVENTION

Embodiments of the present invention relate to a technology for voltage control for electrodes of a display device, particularly to a voltage control method and device for electrodes.

BACKGROUND

FIG. 1 is a schematic plan of an array substrate of prior art. As shown in FIG. 1, the array substrate includes gate lines 10 on the base substrate, and data lines 20 perpendicular to the gate lines 10, wherein the gate lines 10 and the data lines 20 define pixel areas. In the pixel areas, there are pixel electrodes 40, comb-like common electrodes 30 over the pixel electrodes and thin film transistors (TFTs) 50. A long side of the pixel area of the array substrate of this structure is a data line 20, and a short side is a gate line 10.

FIG. 2 is a schematic diagram of input voltage signal of common electrodes on the array substrate shown in FIG. 1. As shown in FIG. 2, a steady voltage signal 41 is input to the common electrodes 30 over the data lines 20.

FIG. 3 is a schematic diagram of input voltage signal of data lines on the array substrate shown in FIG. 1. As shown in FIG. 3, when the voltage signal 21 of data lines 20 varies, the voltage of common electrodes 30 over the data lines 20 will be influenced, resulting in the final output voltage signal of common electrodes 30 as shown in FIG. 4, thereby the coupling capacitance between data lines 20 and common electrodes 30 will be generated, which influences the voltage of common electrodes 30.

At present, large size TV products and 3D products are the trend of development in present TV manufacturing field. However, in order to smoothly develop large size products and 3D products, for example, the driving frequency of the products needs to be increased from 60 Hz to 120 Hz and even 240 Hz.

However, for the array substrate shown in the above-mentioned structure diagram 1, there exists coupling capacitance between data lines 20 and common electrodes 30 and charging time for pixels is short. Therefore, while driving at high frequency, the voltage of common electrodes will be influenced such that the product's picture becomes greenish and the issue of picture distortion will be difficult to be overcome even if a SVC (Switching Virtual Circuit) circuit is used.

SUMMARY

The technical problem to be resolved by the present application is to provide a voltage controlling method for electrodes and a device that can avoid greenish pictures of products due to influence of data line voltage on common electrodes.

In order to address the above-mentioned technical problems, one aspect of the present application provides a voltage control method for electrodes comprising: inputting a varying voltage signal to common electrodes on an array substrate.

Furthermore, the step of inputting the varying voltage signal to common electrodes on the array substrate comprises inputting the varying voltage signal to common electrodes on the array substrate according to voltage variation of data lines on the array substrate.

Furthermore, the step of inputting the varying voltage signal to common electrodes on the array substrate according to the voltage variation of the data lines on the array substrate comprising:

obtaining a total waveform of input voltages for all data lines according to input voltage waveforms for all data lines on the array substrate;

inputting a first compensating voltage signal into common electrodes on the array substrate when the total waveform exhibits as a first voltage signal with high level, wherein the first compensating voltage signal has an opposite polarity to the first voltage signal; and inputting a second compensating voltage signal into common electrodes of the array substrate when the total waveform exhibits as a second voltage signal with low level, wherein the second compensating voltage signal has an opposite polarity to the second voltage signal.

Furthermore, the step of obtaining a total waveform of input voltages for all data lines according to input voltage waveforms for all data lines on the array substrate comprises: obtaining a plurality of input voltage waveforms input into all data lines on the array substrate; and overlapping the plurality of input voltage waveforms to obtain the total waveform of input voltages for all data lines.

A range of a ratio of a pulse width of the first compensating voltage signal input to common electrodes on the array substrate or a range of a ratio of a pulse width of the second compensating voltage signal input to common electrodes on the array substrate to a pulse width of the total waveform of input voltages for all data lines is 0.6%~50%.

For example, when a driving frequency of the array substrate is 60 Hz, the pulse width of the total waveform of the input voltages for the data lines is 16.7 μs, and the range of the pulse width of the first compensating voltage signal input to the common electrodes on the array substrate or the range of the pulse width of the second compensating voltage signal input to the common electrodes on the array substrate is 0.1~8 μs;

For example, when a driving frequency of the array substrate is 120 Hz, the pulse width of the total waveform of the input voltages for the data lines is 8.3 μs, and the range of pulse width of the first compensating voltage signal input to the common electrodes on the array substrate or the range of pulse width of the second compensating voltage signal input to the common electrodes on the array substrate is 0.1~4.2 μs;

For example, when the driving frequency of the array substrate is 240 Hz, the pulse width of the total waveform of the input voltages for the data lines is 4.2 μs, and the range of pulse width of the first compensating voltage signal input to the common electrodes on the array substrate or the second compensating voltage signal input to the common electrodes on the array substrate is 0.1~2.1 μs.

A timing of the first compensating voltage signal or the second compensating signal input to the common electrodes on the array substrate is same as that of a clock controller of the array substrate.

Another aspect of the present invention further provides a voltage control device for electrodes, which comprises a control module configured to input a varying voltage signal to common electrodes on an array substrate.

The control module is further configured to input the varying voltage signal to common electrodes on the array substrate according to voltage variation of all data lines on the array substrate.

The control module is further configured to obtain a total waveform of input voltages for all data lines according to input voltage waveforms for all data lines on the array substrate; input a first compensating voltage signal into common electrodes on the array substrate when the total waveform exhibits as a first voltage signal with high level, wherein the first compensating voltage signal has an opposite polarity to the first voltage signal; and input a second compensating voltage signal into common electrodes on the array substrate when the total waveform exhibits as a second voltage signal with low level, wherein the second compensating voltage signal has an opposite polarity to the second voltage signal.

A range of a ratio of a pulse width of the first compensating voltage signal input to common electrodes on the array substrate or a range of a ratio of a pulse width of the second compensating voltage signal input to common electrodes on the array substrate to a pulse width of the total waveform of input voltages for all data lines is 0.6%~50%.

For example, when a driving frequency of the array substrate is 60 Hz, the pulse width of the total waveform of the input voltages for the data lines is 16.7 μs, and the range of the pulse width of the first compensating voltage signal input by the control module to the common electrodes on the array substrate or the range of the pulse width of the second compensating voltage signal input by the control module to the common electrodes on the array substrate is 0.1~8 μs.

For example, when the driving frequency of the array substrate is 120 Hz, the pulse width of the total waveform of the input voltages for the data lines is 8.3 μs, and the range of pulse width of the first compensating voltage signal input to the common electrodes on the array substrate or the range of pulse width of the second compensating voltage signal input to the common electrodes on the array substrate is 0.1~4.2 μs.

For example, when the driving frequency of the array substrate is 240 Hz, the pulse width of the total waveform of the input voltages for the data lines is 4.2 μs, and the range of pulse width of the first compensating voltage signal input to the common electrodes on the array substrate or the second compensating voltage signal input to the common electrodes on the array substrate is 0.1~2.1 μs.

Benefits of the above-mentioned embodiments of the present invention are as follows.

In the above-mentioned embodiments, a first compensating voltage signal into common electrodes on the array substrate is input when the total waveform exhibits as a first voltage signal with high level, wherein the first compensating voltage signal has an opposite polarity to the first voltage signal; and a second compensating voltage signal into common electrodes on the array substrate is input when the total waveform exhibits as a second voltage signal with low level, wherein the second compensating voltage signal has an opposite polarity to the second voltage signal. Thus, when the voltage of the common electrodes is pulled up due to influence of the first voltage signal of data lines, a first compensating voltage signal with a polarity opposite to the first voltage signal is input into the common electrodes at the same time, enabling the output voltage signal of common electrodes to become smooth. Similarly, when the common electrodes are pulled down due to influence of the second voltage signal of data lines, a second compensating voltage signal with a polarity opposite to the second voltage signal is input into the common electrodes at the same time, enabling the output voltage signal of common electrodes to become smooth. Thereby, the common electrodes are finally made to output a smooth voltage signal, avoiding the problem of becoming greenish due to the influence of data lines on the voltage signal of common electrodes.

BRIEF DESCRIPTION OF DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAIL DESCRIPTION

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at lease one. The terms "comprises," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left"

and the like are only used to indicate relative position relationship, and when the position of the object which is described is changed, the relative position relationship may be changed accordingly.

Figure 1:
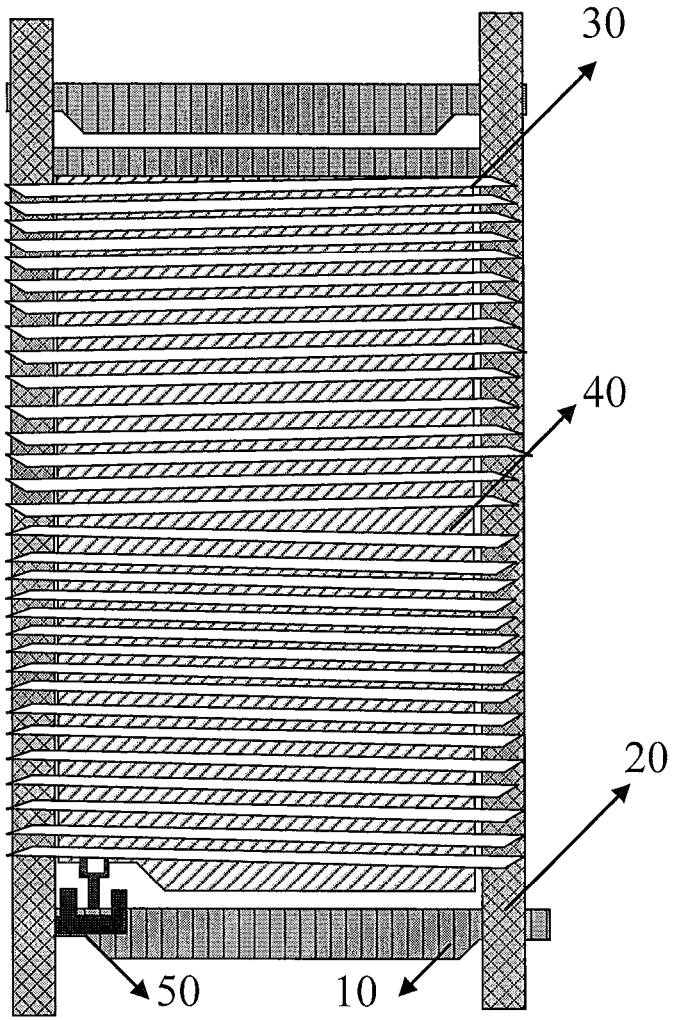
FIG. 1 is a schematic plan of an array substrate of prior art.
Figure 2:
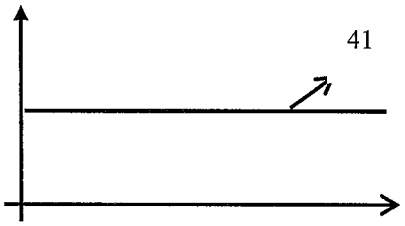
FIG. 2 is a schematic diagram of input voltage signal of common electrodes on the array substrate shown in FIG. 1.
Figure 3:
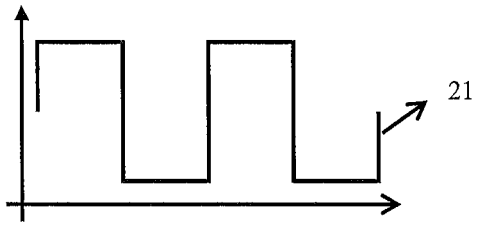
FIG. 3 is a schematic diagram of input voltage signal of data lines on the array substrate shown in FIG. 1.
Figure 4:
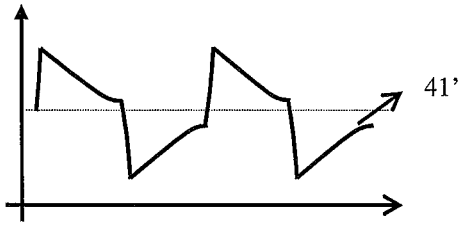
FIG. 4 is a schematic diagram of output voltage signal of common electrodes on the array substrate shown in FIG. 1.
Figure 5:
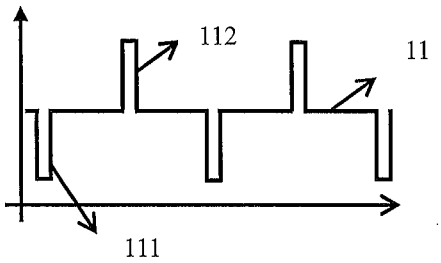
FIG. 5 is a schematic diagram of an input voltage signal of common electrodes according to the present invention.
Figure 6:
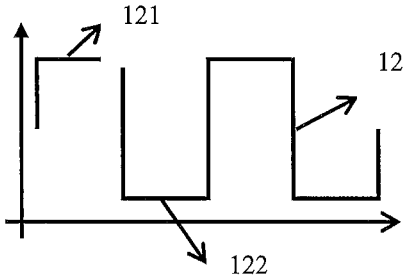
FIG. 6 is a schematic diagram of an input voltage signal of data lines according to the present invention.
Figure 7:
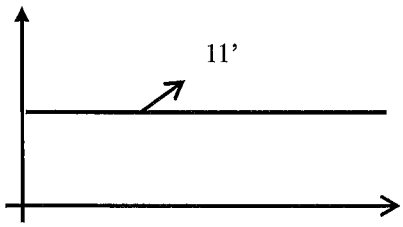
FIG. 7 is a schematic diagram of an output voltage signal of common electrodes according to the present invention.

As shown in FIGS. 5-7, one embodiment of the present invention provides an electrode voltage controlling method, the method includes inputting a varying voltage signal 11 into common electrodes of the array substrate, wherein a varying voltage signal may be input into each of common electrodes on the array substrate depending on voltage variation of data lines on the array substrate.

FIG. 6 shows a schematic diagram of voltage signal 12 of data lines on the array substrate. At a determined resolution, a voltage signal input into each data line on the array substrate is determined. The grey scale value of the final display picture may be predetermined and the total voltage signal of all data lines is also determined, for example, a square wave impulse signal as shown in FIG. 6.

Therefore, according to the determined total voltage signal of data lines, it is possible to determine the amplitude of the voltage signal need to be supplied additionally to common electrodes to minimize the influence of data lines on the voltage of common electrodes to zero, hence preventing signal distortion of common electrodes, when the total voltage signal of data lines jumps.

The above-mentioned step of inputting a varying voltage signal into common electrodes on the array substrate according to the voltage variation of data lines on the array substrate may include: obtaining the total waveform of input voltages of all data lines according to the voltage waveform input into all data lines on the array substrate. When the total waveform exhibits as a first voltage signal 121 with high level, a first compensating voltage signal 111 is input into common electrodes on the array substrate, wherein the first compensating voltage signal 111 has an opposite polarity to the first voltage signal 121. When the total waveform exhibits as a second voltage signal 122 with low level, a second compensating voltage signal 112 is input into common electrodes on the array substrate, wherein the second compensating voltage signal 112 has an opposite polarity to the second voltage signal 122.

The step of obtaining the total waveform of input voltage of all data lines according to the voltage waveforms input into all data lines on the array substrate may include: obtaining a plurality of voltage waveforms input into all data lines on the array substrate; and overlapping the plurality waveforms of the input voltages to obtain the total waveform of input voltages of all data lines.

Figure 8:
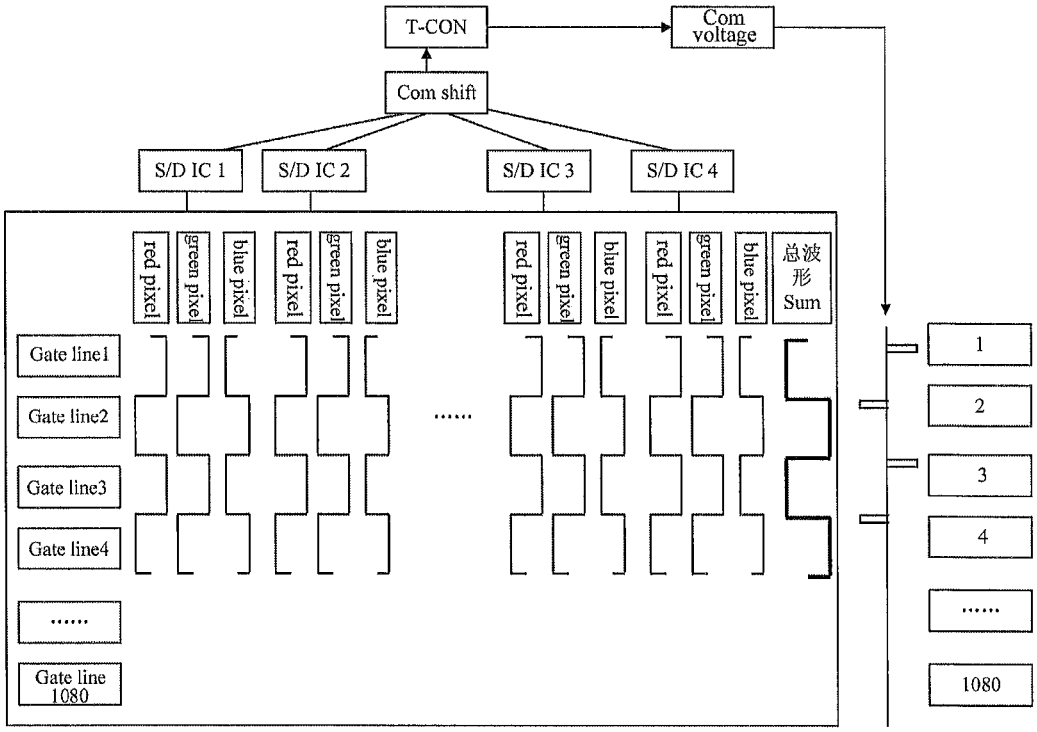
FIG. 8 is a schematic diagram of voltage signal controlling of common electrodes on the array substrate according to the present invention.

A display panel with a resolution of 1920×1080 (namely with 1920 data lines and 1080 gate lines) is illustrated as an example. When the first row of gate lines is turned on, the voltage waveforms of 1920 data lines perpendicular to the gate lines are shown in FIG. 8, which respectively are, a waveform corresponding to the input voltage of the 1920-1 data line, a waveform corresponding to the input voltage of the 1920-2 data line, . . . , a waveform corresponding to the input voltage of the 1920-1920 data line. Waveforms corresponding to input voltages of all data lines are overlapped to obtain the total waveform (Sum) as shown in FIG. 8. For example, the first row of gate line corresponds to the waveform leftward.

Similarly, When the first row of gate lines is turned on, the voltage waveforms of 1920 data lines perpendicular to the gate lines are shown in FIG. 8, which respectively are, a waveform corresponding to the input voltage of the 1920-1 data line, a waveform corresponding to the input voltage of the 1920-2 data line, . . . , a waveform corresponding to the input voltage of the 1920-1920 data line. Waveforms corresponding to input voltages of all data lines are overlapped to obtain the total waveform (Sum) as shown in FIG. 8. For example, the first row of gate line corresponds to the waveform rightward. And so on, the total waveform (Sum) of data lines is obtained, as shown in FIG. 8.

If a total waveform (Sum) is determined, it is possible to predict the amount of Com distortion caused by data line voltage waveforms and the compensating amount for Com signal distortion.

When the voltage signal 12 of the total waveform (Sum) of data lines transits from low level to high level, the output voltage of common electrodes will be pulled up due to the influence of high level transient voltage of data lines, and now a first compensating voltage signal 111 with a polarity opposite to the current voltage of data lines is input to the common electrodes to counteract the pulled up voltage of common electrodes, thereby allowing the output voltage of common electrodes being still a smooth voltage signal.

Similarly, when the voltage signal 12 of the total waveform (Sum) of data lines transits from high level to low level, the output voltage of common electrodes will be pulled down due to the influence of low level transient voltage of data lines, and now a second compensating voltage signal 112 with a polarity opposite to the current voltage of data lines is input into the common electrodes to counteract the pulled down voltage of common electrodes, thereby allowing the output voltage of common electrodes being still a smooth voltage signal. Finally, the common electrodes output a smooth output voltage 11' as shown in FIG. 7.

In the above embodiment, the range of ratio of the pulse width of the first compensating voltage signal or the pulse width of the second compensating voltage signal input to common electrodes on the array substrate to the pulse width of the total waveform of input voltage of all data lines is: 0.6%~50%.

For example, when the driving frequency of the array substrate is 60 Hz, the pulse width of the total waveform of the input voltage of the data line is 16.7 μs, the range of pulse width of the first compensating voltage signal 111 input to the common electrodes on the array substrate or the range of pulse width of the second compensating voltage signal 112 input to the common electrodes on the array substrate is 0.18 μs.

For example, when the driving frequency of the array substrate is 120 Hz, the pulse width of the total waveform of the input voltage of the data lines is 8.3 μs, the range of pulse width of the first compensating voltage signal 111 input to the common electrodes on the array substrate or the range of pulse width of the second compensating voltage signal 112 input to the common electrodes on the array substrate is 0.1~4.2 μs.

For example when the driving frequency of the array substrate is 240 Hz, the pulse width of the total waveform of the input voltage of the data lines is 4.2 μs, the range of pulse width of the first compensating voltage signal 111 input to the common electrodes of the array substrate or the range of pulse width of the second compensating voltage signal 112 input to the common electrodes of the array substrate is 0.1~2.1 μs.

In summary, the pulse width of the first compensating voltage signal 111 is smaller than the pulse width of the first voltage signal 121 of the total waveform of data lines; and the pulse width of the second compensating voltage signal 112 is smaller than the pulse width of the second voltage signal 122 of the total waveform of data lines.

Specifically, if the total waveform of data lines shows for a high level voltage of +3V, the voltage signal compensated for the common electrodes is predicted as −2.8V; if the total waveform of data lines shows for at a low level voltage of −3V, the voltage signal compensated for the common electrodes is predicted as +2.8V. Of course, specific compensation amount and polarities of compensating voltages are not limited to the illustrative values, but are determined by the total practical voltage waveform of data lines.

FIG. 8 shows the voltage control of common electrodes on the array substrate. An example for illustration is provided with 1080 rows of gate scan lines wherein all data lines (1920) are driven by S/D IC (data line driving chip) circuits in peripheral circuits, the waveforms of the pulses of voltage signal for each pixel are waveforms corresponding to red, green and blue pixels in the figure, and the waveform of voltage signals of data lines corresponding to the gray-scale of the entire display picture is like the waveform corresponding to the total waveform (Sum).

The control timing of input voltages of common electrodes is controlled by the timing of the T-COM clock controller of the array substrate, that is, the timing of the first compensating voltage signal or the second compensation signal is the same as that of the clock controller (T-CON) of the array substrate. When a voltage signal is input to each data line, the first compensating voltage signal and the second compensating voltage signal as describe above are input to the common electrodes according to the timing of the clock controller (T-CON), thereby making the voltage signal output from the common electrodes steady.

For example, when the first row of gate lines is turned on, the voltage waveforms of 1920 data lines perpendicular to the gate lines are shown in FIG. 8, which respectively are, a waveform corresponding to the input voltage of the 1920-1 data line, a waveform corresponding to the input voltage of the 1920-2 data line, . . . , a waveform corresponding to the input voltage of the 1920-1920 data line. Waveforms corresponding to input voltages of all data lines are overlapped to obtain the total waveform (Sum) as shown in FIG. 8. For example, the first row of gate line corresponds to the waveform leftward.

Similarly, When the first row of gate lines is turned on, the voltage waveforms of 1920 data lines perpendicular to the gate lines are shown in FIG. 8, which respectively are, a waveform corresponding to the input voltage of the 1920-1 data line, a waveform corresponding to the input voltage of the 1920-2 data line, . . . , a waveform corresponding to the input voltage of the 1920-1920 data line. Waveforms corresponding to input voltages of all data lines are overlapped to obtain the total waveform (Sum) as shown in FIG. 8. For example, the first row of gate line corresponds to the waveform rightward. And so on, the total waveform (Sum) of data lines is obtained, as shown in FIG. 8.

If a total waveform (Sum) is determined, it is possible to predict the amount of Com distortion caused by data line voltage waveforms and the compensating amount for Com signal distortion.

When the voltage signal of the total waveform of data lines transits from low level to high level, the output voltage of common electrodes will be pulled up due to the influence of high level transient voltage of data lines, and now a first compensating voltage signal with a polarity opposite to the current voltage of data lines is input to the common electrodes to counteract the pulled up voltage of common electrodes, thereby allowing the output voltage of common electrodes being still a smooth voltage signal. The compensation signal 1 is shown in FIG. 8.

Similarly, when the voltage signal of the total waveform of data lines transits from high level to low level, the output voltage of common electrodes will be pulled down due to the influence of low level transient voltage of data lines, and now a second compensating voltage signal with a polarity opposite to the current voltage of data lines is input into the common electrodes to counteract the pulled down voltage of common electrodes, thereby allowing the output voltage of common electrodes being still a smooth voltage signal. The compensating signal 2 of common electrodes is shown in FIG. 8. So on and so forth, the common electrodes finally output a smooth com voltage as shown in FIG. 8, avoiding the Greenish problem due to the influence of data lines on the voltage signal of common electrodes.

With the above-mentioned method according to the present invention, the distortion introduced by data signals is counteracted by predicting the distortion amount of common electrodes and compensating voltage signals with a polarity direction opposite to data signals for common electrodes at the instant that the distortion starts (namely the instant of outputting data signals), and thereby avoiding signal distortion of common electrodes.

In addition, another embodiment of the present invention further provides a voltage control device for electrodes, which comprises a control module configured to input a varying voltage signal to common electrodes on an array substrate.

The control module is further configured to input the varying voltage signal to common electrodes on the array substrate according to voltage variation of all data lines on the array substrate.

The control module is further configured to obtain a total waveform of input voltages for all data lines according to input voltage waveforms for all data lines on the array substrate; input a first compensating voltage signal into common electrodes on the array substrate when the total waveform exhibits as a first voltage signal with high level, wherein the first compensating voltage signal has an opposite polarity to the first voltage signal; and input a second compensating voltage signal into common electrodes on the array substrate when the total waveform exhibits as a second voltage signal with low level, wherein the second compensating voltage signal has an opposite polarity to the second voltage signal.

A range of a ratio of a pulse width of the first compensating voltage signal input to common electrodes on the array substrate or a range of a ratio of a pulse width of the second compensating voltage signal input to common electrodes on the array substrate to a pulse width of the total waveform of input voltages for all data lines is 0.6%~50%.

For example, when a driving frequency of the array substrate is 60 Hz, the pulse width of the total waveform of the input voltages for the data lines is 16.7 μs, and the range of the pulse width of the first compensating voltage signal input by the control module to the common electrodes on the array substrate or the range of the pulse width of the second compensating voltage signal input by the control module to the common electrodes on the array substrate is 0.1~8 μs. The timing of the first compensating voltage signal and the second compensating voltage signal is same as that of a clock controller of the array substrate.

For example, when the driving frequency of the array substrate is 120 Hz, the pulse width of the total waveform of the input voltages for the data lines is 8.3 μs, and the range of pulse width of the first compensating voltage signal input to the common electrodes on the array substrate or the range of pulse width of the second compensating voltage signal input to the common electrodes on the array substrate is 0.1~4.2 μs. The timing of the first compensating voltage signal and the second compensating voltage signal is same as that of a clock controller of the array substrate.

For example, when the driving frequency of the array substrate is 240 Hz, the pulse width of the total waveform of the input voltages for the data lines is 4.2 μs, and the range of pulse width of the first compensating voltage signal input to the common electrodes on the array substrate or the second compensating voltage signal input to the common electrodes on the array substrate is 0.1~2.1 μs. The timing of the first compensating voltage signal and the second compensating voltage signal is same as that of a clock controller of the array substrate.

The control module may be for example the above-mentioned voltage driving circuit for common electrodes with the same timing as T-CON, and may also be other components that can charge the common electrodes in the array substrate.

In the abovesaid embodiment, the device may input a first compensating voltage signal into common electrodes on the array substrate when the total waveform exhibits as a first voltage signal with high level, wherein the first compensating voltage signal has an opposite polarity to the first voltage signal; and input a second compensating voltage signal into common electrodes on the array substrate when the total waveform exhibits as a second voltage signal with low level, wherein the second compensating voltage signal has an opposite polarity to the second voltage signal. Thus, when the voltage of the common electrodes is pulled up due to influence of the first voltage signal of data lines, a first compensating voltage signal with a polarity opposite to the first voltage signal is input into the common electrodes at the same time, enabling the output voltage signal of common electrodes to become smooth. Similarly, when the common electrodes are pulled down due to influence of the second voltage signal of data lines, a second compensating voltage signal with a polarity opposite to the second voltage signal is input into the common electrodes at the same time, enabling the output voltage signal of common electrodes to become smooth. Thereby, the common electrodes are finally made to output a smooth voltage signal, avoiding the problem of becoming greenish due to the influence of data lines on the voltage signal of common electrodes.

What have been described above are preferred implementations of the present invention, it should be noted that for those of ordinary skill in the art, a number of improvements and modifications may be further made without departing from the technical principle of the present invention, and these improvements and modifications should also be regarded as the protection scope of the present invention.

The invention claimed is:

1. A voltage control method for electrodes, comprising:

inputting a varying voltage signal to common electrodes on an array substrate according to voltage variation of data lines on the array substrate;

wherein the inputting the varying voltage signal to common electrodes on the array substrate according to the voltage variation of the data lines on the array substrate comprising:

obtaining a plurality of input voltage waveforms input into all data lines on the array substrate;

overlapping the plurality of input voltage waveforms to obtain the total waveform of input voltages for all data lines;

inputting a first compensating voltage signal into common electrodes on the array substrate when the total waveform exhibits as a first voltage signal with high level, wherein the first compensating voltage signal has an opposite polarity to the first voltage signal; and inputting a second compensating voltage signal into common electrodes of the array substrate when the total waveform exhibits as a second voltage signal with low level, wherein the second compensating voltage signal has an opposite polarity to the second voltage signal;

wherein a range of a ratio of a pulse width of the first compensating voltage signal input to common electrodes on the array substrate or a range of a ratio of a pulse width of the second compensating voltage signal input to common electrodes on the array substrate to a pulse width of the total waveform of input voltages for all data lines is 0.6%~50%.

2. The method of claim 1, wherein, when a driving frequency of the array substrate is 60 Hz, the pulse width of the total waveform of the input voltages for the data lines is 0.0167 ms, and the range of the pulse width of the first compensating voltage signal input to the common electrodes on the array substrate or the range of the pulse width of the second compensating voltage signal input to the common electrodes on the array substrate is 0.0001~0.008 ms;

when a driving frequency of the array substrate is 120 Hz, the pulse width of the total waveform of the input voltages for the data lines is 0.0083 ms, and the range of pulse width of the first compensating voltage signal input to the common electrodes on the array substrate or the range of pulse width of the second compensating voltage signal input to the common electrodes on the array substrate is 0.0001~0.0042 ms;

when the driving frequency of the array substrate is 240 Hz, the pulse width of the total waveform of the input voltages for the data lines is 0.0042 ms, and the range of pulse width of the first compensating voltage signal input to the common electrodes on the array substrate or the second compensating voltage signal input to the common electrodes on the array substrate is 0.0001~0.0021 ms.

3. The method of claim 1, wherein a timing of the first compensating voltage signal or the second compensating signal input to the common electrodes on the array substrate is same as that of a clock controller of the array substrate.

4. A voltage control device for electrodes, comprising:

a control module configured to input a varying voltage signal to common electrodes on an array substrate, wherein the control module is further configured to input the varying voltage signal to common electrodes on the array substrate according to voltage variation of all data lines on the array substrate, and wherein the control module is further configured to:

obtaining a plurality of input voltage waveforms input into all data lines on the array substrate;

overlapping the plurality of input voltage waveforms to obtain the total waveform of input voltages for all data lines;

input a first compensating voltage signal into common electrodes on the array substrate when the total waveform exhibits as a first voltage signal with high level, wherein the first compensating voltage signal has an opposite polarity to the first voltage signal; and input a second compensating voltage signal into common electrodes on the array substrate when the total waveform exhibits as a second voltage signal with low level, wherein the second compensating voltage signal has an opposite polarity to the second voltage signal;

wherein a range of a ratio of a pulse width of the first compensating voltage signal input to common electrodes on the array substrate or a range of a ratio of a pulse width of the second compensating voltage signal input to common electrodes on the array substrate to a pulse width of the total waveform of input voltages for all data lines is 0.6%~50%.

5. The device of claim 4, wherein, when a driving frequency of the array substrate is 60 Hz, the pulse width of the total waveform of the input voltages for the data lines is 0.0167 ms, and the range of the pulse width of the first compensating voltage signal input by the control module to the common electrodes on the array substrate or the range of the pulse width of the second compensating voltage signal input by the control module to the common electrodes on the array substrate is 0.0001~0.008 ms;

when the driving frequency of the array substrate is 120 Hz, the pulse width of the total waveform of the input voltages for the data lines is 0.0083 ms, and the range of pulse width of the first compensating voltage signal input to the common electrodes on the array substrate or the range of pulse width of the second compensating voltage signal input to the common electrodes on the array substrate is 0.0001~0.0042 ms;

when the driving frequency of the array substrate is 240 Hz, the pulse width of the total waveform of the input voltages for the data lines is 0.0042 ms, and the range of pulse width of the first compensating voltage signal input to the common electrodes on the array substrate or the second compensating voltage signal input to the common electrodes on the array substrate is 0.0001~0.0021 ms.

6. The method of claim 1, wherein a timing of the first compensating voltage signal or the second compensating signal input to the common electrodes on the array substrate is same as that of a clock controller of the array substrate.

7. The method of claim 1, wherein a timing of the first compensating voltage signal or the second compensating signal input to the common electrodes on the array substrate is same as that of a clock controller of the array substrate.

8. The method of claim 2, wherein a timing of the first compensating voltage signal or the second compensating signal input to the common electrodes on the array substrate is same as that of a clock controller of the array substrate.

* * * * *